United States Patent [19]

Yoshioka et al.

[11] 4,256,486

[45] Mar. 17, 1981

[54] MARTENSITIC STAINLESS STEEL HAVING EXCELLENT WELDABILITY AND WORKABILITY FOR STRUCTURAL USE

[75] Inventors: Keiichi Yoshioka, Chiba; Noboru Kinoshita; Yutaka Ono, both of Ichihara; Nobuo Ohashi, Funabashi, all of Japan

[73] Assignee: Kawasaki Steel Corporation, Kobe, Japan

[21] Appl. No.: 62,403

[22] Filed: Jul. 31, 1979

[30] Foreign Application Priority Data

Aug. 4, 1978 [JP] Japan ..... 53/94487

[51] Int. Cl.[3] ..... C22C 38/16

[52] U.S. Cl. ..... 75/125; 75/126 B; 75/126 J; 75/128 A; 75/128 N

[58] Field of Search ..... 75/125, 126 R, 126 B, 75/126 J, 128 R, 128 A, 128 N; 148/37

[56] References Cited

U.S. PATENT DOCUMENTS

| | | | |
|---|---|---|---|
| 2,891,859 | 6/1959 | Kegerise | 75/128 N |
| 3,650,731 | 3/1972 | Aggen | 75/125 |
| 3,778,316 | 12/1973 | Pinnow et al. | 75/128 T |

FOREIGN PATENT DOCUMENTS 51-13463 4/1976 Japan .

OTHER PUBLICATIONS

*Nachschlagewerk Stalshlussel,* Verlag Stahlschlüssel Wegst KG., West Germany, p. 244 (1974).

*Primary Examiner*—Michael L. Lewis

*Attorney, Agent, or Firm*—Balogh, Osann, Kramer, Dvorak, Genova & Traub

[57] ABSTRACT

Martensitic stainless steel having excellent weldability and workability for structural use is obtained by limiting each content of carbon and nitrogen to the low value less than 0.02% and the content of nickel to less than 0.1% and by satisfying the following requirement.

$$\text{Cr equivalent} = [\%Cr] + 0.4 \times [\%Si] - 0.4 \times [\%Mn] - 0.7 \times [\%Ni] - 0.6 \times [\%Cu] - 35 \times [\%C] - 10 \times [\%N] \leqq 10.5,$$

wherein % means weight % of the element in steel.

1 Claim, 1 Drawing Figure

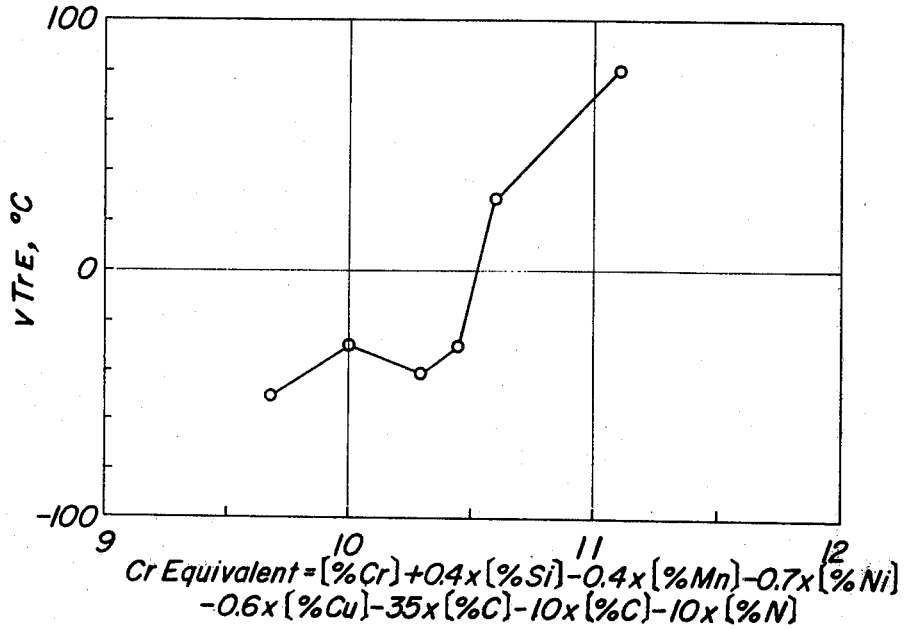
100
0
-100
VTrE, °C
9
10
11
12
Cr Equivalent = [%Cr]+0.4x[%Si]-0.4x[%Mn]-0.7x[%Ni]
-0.6x[%Cu]-35x[%C]-10x[%C]-10x[%N]

MARTENSITIC STAINLESS STEEL HAVING EXCELLENT WELDABILITY AND WORKABILITY FOR STRUCTURAL USE

The present invention relates to martensitic stainless steel having excellent weldability and workability for structural use.

In general, characteristics of martensitic stainless steels are the heat treatability which can provide the excellent mechanical properties such as high proof and tensile strength coupled with corrosion resistance to mild environments and cheapness. However, conventional martensitic stainless steels specified in JIS, such as SUS410, SUS420$J_1$, and SUS420$J_2$, have not been used so widely as the structural materials, which is due to the following two reasons.

Firstly, toughness and workability of the martensitic stainless steels are poor in their welded portion and a crack is liable to be caused at the welding joint during welding irrelative to welding process because of their high content of interstitial elements. For preventing the crack, it is essential to heat the steels before and after welding, which is often difficult for actual construction.

Secondly, noticeable cracks are formed at the sheared edge of the steel plates, especially of pickled ones, in the case that shearing or bending after shearing is conducted to thicker plates of these steels. The steels are used to be tempered after quenching in order to obtain the strength and toughness required of structural steel. When welding is carried out remaining the scale formed on the surface of the plates during hot rolling and the heat treatments, the scale is admixed into the welded portion resulting in deterioration in toughness, workability and fatigue strength of the portion. Therefore, the scale must be removed by pickling before welding.

Hence the steels have had bainite or tempered martensitic structure, and then mechanical properties of the steels are influenced by hydrogen absorbed in the plates during pickling.

Accordingly, the development of the martensitic stainless steel without the two drawbacks described above is very significant in technical and commercial meanings. Recent advance in steel-making technique enables, in low cost, to reduce the contents of carbon and nitrogen in stainless steels and a martensitic stainless steel having a low sensitivity to welding crack has been produced under application of the newly developed technique (Japanese Patent Application Publication No. 13,463/76).

The inventors have aimed at the improvement of the martensitic stainless steel. The main points to be improved are not only to increase toughness and workability of welded portion, but also to decrease sensitivity to the cracking at sheared edge of pickled plates during bending. Effect of alloying element of these two properties of low intersticial martensitic stainless steel was investigated and keys to improve the properties of the steel have been found.

The present invention resides in the structural steels having excellent toughness and workability at welded portions. The steel is charcterized in the contents of carbon and nitrogen lowered to not more than 0.02% respectively and the content of nickel of less than 0.1%, whereby the structure having the strength required of the structural steel is obtained, and the cracking of the pickled steel sheet during shearing and the working cracking after shearing do not occur, and the following requirement is satisfied.

$$\text{Cr equivalent} = [\%Cr] + 0.4 \times [\%Si] - 0.4 \times [\%Mn] - 0.7 \times [\%Ni] - 0.6 \times [\%Cu] - 35 \times [\%C] - 10 \times [\%N] \leqq 10.5$$

Then, an explanation will be made with respect to the reason of limitation of the components of the martensitic stainless steels for structural use according to the present invention.

C and N: The decrease of the content of these components is essential for the improvement of the toughness and workability of the heat affected zone and the upper limit of both carbon and nitrogen is 0.02% considering the prevention of the welding cracking. The lower content of both the components is more desirable.

Mn: This component forms the austenite phase at a high temperature and controls the grain growth, so that this component is effective for the improvement of toughness. When this component is less than 1%, the austenite phase of the welding heat affected zone at a high temperature is few and then the toughness and workability are lowered by coarsening the crystal grain. So, the lower limit is 1%. However, when this component exceeds 3.5%, the oxidation resistance at a high temperature lowers and the heavy formation of scales in the production process of the steel sheet makes the sheet surface rough upon pickling and the dimension accuracy of the sheet is considerably lowered, so that the upper limit is 3.5%.

Cu: This component forms the austenite phase in the same manner as in manganese at a high temperature and is an effective element for the improvement of the toughness of the welded portion. The object of the present invention is satisfied by making Cr equivalent to be not more than 10.5 by adding copper together with manganese but when exceeding 1%, hot cracks are formed and the production yield of the sheet is considerably lowered, so that the upper limit is 1.0%.

Ni: Table 1 shows the bending test result on the pickled steel sheets after shearing, in which the content of nickel is varied but the other components are within the range of the present invention. As shown in Table 1, when the nickel content exceeds 0.1%, cracking is caused at sheared edges during working on the sheared and pickled sheet in which the strength as the structure steel is provided. Accordingly, the nickel content must be less than 0.1% in order to avoid this problem and this is one of the great features of the present invention.

| Bending test result on sheared and pickled steel sheet (thickness: about 10 mm; bending radius $\gamma = 2t$) | | | | | |
|---|---|---|---|---|---|
| Ni content (%) | | | | | |
| <0.01 | 0.03 | 0.09 | 0.10 | 0.24 | 0.77 |
| not crack | not crack | not crack | crack | crack | crack |

Cr: It is essential in order to maintain the corrosion resistance that the lower limit of Cr is 10%. When the content exceeds 13.5%, it is necessary in order to maintain the toughness and workability of the welded portion to add the austenite forming elements, such as manganese and copper in an amount exceeding the upper limit of these elements and the hindrance as mentioned above in the reason of the limitation of manganese and copper occurs. So, the upper limit of chrominum is 13.5%.

Si: Silicon is the element for lowering the toughness and should be as low as possible and in order to accomplish the object of the present invention, the upper limit must be 0.5%.

Other than the main components explained above in the present invention, phosphorus as the main component among the components contained in the steel composition as impurities must be as low as possible in view of the toughness and it is desirable that sulfur is low in view of the rust resistance. Oxygen is harmful in view of the toughness and the strong deoxidation of aluminum is preferable as a deoxidizing agent.

For better understanding of the invention, reference is taken to the accompanying drawing.

The attached drawing shows the relation of Cr equivalent in the case of carbon and nitrogen contents not more than 0.02% respectively to the ductile-brittle energy transition temperature decided by 2 mm V-notch charpy impact test on the welding heat affected zone having the thickness of 5 mm. When Cr equivalent exceeds 10.5, the toughness of the heat affected zone considerably lowers and coarse ferrite grains are observed at the heat affected zone. So, it is considered that the coarsening of the crystal grain is the cause of lowering of the toughness, and Cr equivalent must be controlled to be not more than 10.5 in view of maintaining of the toughness.

The following examples are given for the purpose of illustration of this invention and are not intended as limitations thereof.

EXAMPLES

Steels having the components in NO. 1–No. 8 shown in the following Table 2 were melted in vacuum-induction furnace having the capacity of 100 kg and the 100 kg ingot steels were hot rolled under the known conditions into hot rolled sheets having a thickness of 12 mm. Then, sheets were subjected to the heat treatment suitable for each steel to prepare each steel sheet having the proof strength of about 40 kg/mm$^2$ and the tensile strength of 60 kg/mm$^2$. Each steel sheet was subjected to shot blast and pickling and then applied to the test.

TABLE 2

| | No. | C | Si | Mn | P | S | Ni | Cr | Cu | N | Al | Cr equivalent |
|---|---|---|---|---|---|---|---|---|---|---|---|---|
| Present invention | 1 | 0.01 | 0.15 | 1.51 | 0.021 | 0.006 | 0.06 | 11.12 | Tr | 0.008 | 0.05 | 10.1 |
| | 2 | 0.01 | 0.17 | 2.55 | 0.024 | 0.004 | <0.01 | 11.6 | Tr | 0.009 | 0.03 | 10.2 |
| | 3 | 0.01 | 0.14 | 1.50 | 0.025 | 0.006 | 0.05 | 11.2 | 0.31 | 0.009 | 0.03 | 10.0 |
| | 4 | 0.01 | 0.14 | 2.60 | 0.022 | 0.007 | 0.03 | 12.3 | 0.70 | 0.010 | 0.02 | 10.4 |
| Comparative steel | 5 | 0.01 | 0.18 | 0.92 | 0.024 | 0.005 | 0.42 | 11.4 | Tr | 0.011 | 0.03 | 10.4 |
| | 6 | 0.02 | 0.16 | 1.01 | 0.022 | 0.005 | 0.21 | 11.3 | 0.33 | 0.010 | 0.04 | 9.8 |
| | 7 | 0.03 | 0.23 | 1.49 | 0.024 | 0.004 | 0.01 | 11.4 | Tr | 0.014 | 0.02 | 9.7 |
| | 8 | 0.02 | 0.20 | 1.12 | 0.024 | 0.005 | 0.02 | 11.5 | Tr | 0.033 | 0.01 | 10.1 |

The welding was carried out by MIG welding and the welding wire was 1.6 mmϕ of SUS309 welding rod.

The mechanical properties of the sheet and MIG welding joint portion are shown in the following Table 3. The steels of the present invention are superior to the comparative steels in the workability and mechanical properties of welding joint of the sheets and have very excellent properties as the structural steel.

TABLE 3

| | | Base sheet | Welded portion | | |
|---|---|---|---|---|---|
| | No. | Bending test on* sheared test piece (r = 2t, 180°) | γ-groove** restraint cracking test | Bending test* (r = 2t, 180°) | Ductile-brittle (energy)** transition temperature of heat affected zone (°C.) |
| Present invention | 1 | no crack | no root crack | no crack | −20 |
| | 2 | " | " | " | −10 |
| | 3 | " | " | " | −20 |
| | 4 | " | " | " | −20 |
| Comparative Steel | 5 | crack at sheared edge portion | " | " | −10 |
| | 6 | crack at sheared edge portion | " | " | −20 |
| | 7 | not crack | root crack | crack | +60 |
| | 8 | " | " | " | +70 |

*tested with reference to JIS Z 2248
**tested with reference to JIS Z 3158
***tested on half-size specimens with reference to JIS Z 2242

What is claimed is:

1. Martensitic stainless steel having excellent weldability and workability for structural use consisting of not more than 0.02% of C, not more than 0.02% of N, 1.0–3.5% of Mn, not more than 1.0% of Cu, less than 0.1% of Ni, 10–13.5% of Cr, not more than 0.5% of Si, and the remainder being incidental impurities and iron and the following requirement being satisfied;

$$\text{Cr equivalent} = [\%Cr] + 0.4\times[\%Si] - 0.4\times[\%Mn] - 0.7\times[\%Ni] - 0.6\times[\%Cu] - 35\times[\%C] - 10\times[\%N] \leqq 10.5.$$

* * * * *